US007023354B2

(12) United States Patent
Perry et al.

(10) Patent No.: US 7,023,354 B2
(45) Date of Patent: Apr. 4, 2006

(54) PLATFORM ASSEMBLY

(75) Inventors: William Bryan Perry, Titiusville, FL (US); David Earl Headley, Cocoa, FL (US)

(73) Assignee: The Boeing Company, Chicago, IL (US)

( * ) Notice: Subject to any disclaimer, the term of this patent is extended or adjusted under 35 U.S.C. 154(b) by 121 days.

(21) Appl. No.: 10/814,678

(22) Filed: Mar. 31, 2004

(65) Prior Publication Data

US 2005/0225450 A1 Oct. 13, 2005

(51) Int. Cl.
*G08B 21/00* (2006.01)

(52) U.S. Cl. ..... 340/665; 340/540; 703/8

(58) Field of Classification Search ..... 340/665, 340/540, 522, 541, 556, 573.1, 686.1; 703/8; 73/37; 56/10.2 E, 10.2 R
See application file for complete search history.

(56) References Cited

U.S. PATENT DOCUMENTS 4,302,745 A * 11/1981 Johnston et al. ..... 340/963
5,633,452 A * 5/1997 Bebernes ..... 73/37
6,043,741 A * 3/2000 Whitmarsh ..... 340/540
6,186,280 B1 * 2/2001 Healy ..... 187/207

* cited by examiner

*Primary Examiner*—Anh V. La
(74) *Attorney, Agent, or Firm*—Sonnenschein Nath & Rosenthal, LLP

(57) ABSTRACT

An automated warning system for a platform assembly. The system includes a measuring device mountable on the platform assembly for measuring a parameter representing loading on the assembly, a warning device for generating a warning, and a processor operatively connected to the measuring device and the warning device. The processor is configured to receive information relating to at least one of the design and operation of at least one of the platform assembly and the object, determine a limit for the parameter based on the information, compare the parameter to the limit, and activate the warning device to generate a warning when the parameter compares unfavorably to the limit.

20 Claims, 5 Drawing Sheets

PLATFORM ASSEMBLY

BACKGROUND OF THE INVENTION

The present invention relates generally to platform assemblies, and more specifically to platform assemblies for providing access to an object.

Platform assemblies are often attached to, or constructed near, an object (e.g., a vehicle or a building) to provide access to parts of the object that may be difficult to access when working on the object. For example, platform assemblies may be constructed near a space vehicle (e.g., a space shuttle) to provide access to parts of the vehicle located out of the reach of people and/or equipment on the ground. However, platform assemblies are sometimes overloaded with equipment and personal beyond their operational limits. Additionally, platform assemblies may be improperly constructed and/or attached to the object. When platform assemblies are overloaded, improperly constructed, and/or improperly attached to objects they may unexpectedly fail, possibly causing injury to people on or near the platforms, and/or causing damage to the objects, equipment near the objects, and/or the assemblies themselves. Warnings are sometimes printed on platform assemblies to indicate the operational limits and the proper construction/attachment of the assemblies. However, the operational limits of platform assemblies may vary depending upon the construction, attachment, and/or configuration of an assembly for a particular application. Accordingly, any written warnings on the components of the assembly may be incorrect when it is constructed, attached, and/or configured for a different application. Additionally, people working on platform assemblies may inadvertently exceed operational limits even when written warnings are present.

SUMMARY OF THE INVENTION

In one aspect, the present invention includes an automated warning system for a platform assembly. The system includes a measuring device mountable on the platform assembly for measuring a parameter representing loading on the assembly, a warning device for generating a warning, and a processor operatively connected to the measuring device and the warning device. The processor is configured to receive information relating to at least one of the design and operation of at least one of the platform assembly and the object, determine a limit for the parameter based on the information, compare the parameter to the limit, and activate the warning device to generate a warning when the parameter compares unfavorably to the limit.

In another aspect, the present invention includes a platform assembly for providing access to an object. The assembly includes a support, a platform extending from the support for providing access to the object, a measuring device mounted on at least one of the platform, the support, and the object for measuring a parameter representing loading on at least one of the platform, the support, and the object, a warning device generating a warning, and a processor operatively connected to the measuring device and the warning device. The processor is configured to receive information relating to at least one of the design and the operation of at least one of the platform assembly and the object, determine a limit for the parameter based on the information, compare the parameter to the limit, and activate the warning device to generate a warning when the parameter compares unfavorably to the limit.

In yet another aspect, the present invention includes an automated warning system for a platform assembly attached to an object. The system includes a measuring device mountable on the object for measuring a parameter representing loading on the object resulting from force transmitted from the platform assembly to the object. The system also includes a warning device for generating a warning, and a processor operatively connected to the measuring device and the warning device. The processor is configured to compare the parameter to a limit for the parameter, and activate the warning device to generate a warning when the parameter compares unfavorably to the limit.

In even another aspect, a method is provided for representing how a parameter of an object that results from force transmitted from a platform assembly to the object compares to a limit for the parameter. The method includes attaching a platform assembly to the object for access to the object, measuring the parameter of the object resulting from force transmitted from the platform assembly to the object, comparing the parameter to the limit, and generating a warning representing how the parameter compares to the limit.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
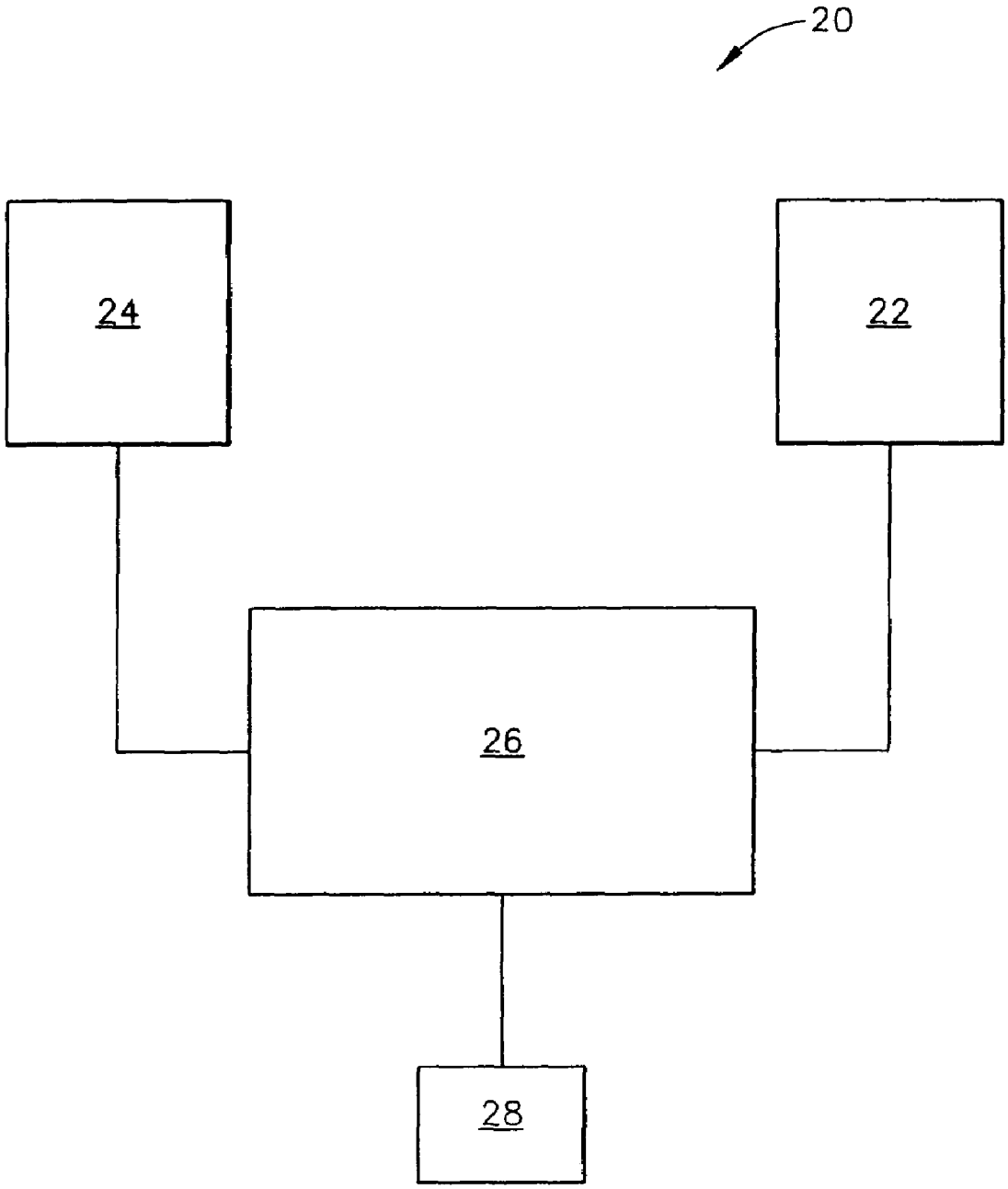
FIG. 1 is a schematic of an automated warning system of the present invention.

Referring now to the drawings, and more specifically to FIG. 1, an automated warning system of the present invention is designated in its entirety by the reference numeral 20. The system 20 may be used in combination with, or as a component of, a platform assembly (e.g., assembly 50 shown in FIG. 2) for accessing an object (e.g., space vehicle 52 shown in FIG. 2, a building, a topographical feature, or a living organism). The system 20 includes a measuring device 22 mountable on the platform assembly and/or the object for measuring a preselected parameter representative of platform loading (e.g., stress, strain, torque, etc.). The parameter may represent loading on the platform assembly directly and/or represent loading on the object that results from force transmitted from the platform assembly to the object. The system 20 also includes a warning device 24 for generating a warning, and a processor 26 operatively connected to the measuring device 22 and the warning device. The processor 26 may include an interface 28 for receiving information relating to the design and/or operation of the platform assembly and/or the object (e.g., a size, shape, material and/or configuration of the platform assembly, the object, and/or a component of the platform assembly and/or the object) from storage devices (not shown), other measuring devices (not shown), and/or other processors (not shown), as well as for general communication with the storage devices, the other measuring devices, and the other processors.

Briefly, the system 20 is operative to measure a parameter of the platform assembly and/or the object, and activate the warning device 24 to generate a warning when the parameter compares unfavorably to a limit (e.g., a value of the parameter at which the platform assembly, the object, and/or a component of the assembly and/or the object is predicted to fail, referred to herein as a "failure value"). An example of a component of the assembly is the platform 58 shown in FIG. 2. An example of a component of the object is the vertical stabilizer 124 shown in FIG. 5. Specifically, and referring again to FIG. 1, the processor receives the information relating to the design and/or operation of the platform assembly and/or the object, determines the limit for the parameter based on the information, and compares the parameter measured by the measuring device 22 to the limit. The processor 26 activates the warning device 24 to generate a warning when the parameter compares unfavorably to the limit. Alternatively, the limit is predetermined and is received by the processor 26 for use thereby. In one embodiment the processor 26 selects the parameter and/or a location thereof based on the information relating to the design and/or operation of the platform assembly and/or the object, and/or based on other information. As described below in more detail, by generating warnings when parameters of platform assemblies and/or objects compare unfavorably to certain limits, the systems of the present invention may reduce injury to people working on or near the assemblies and/or damage to the objects, equipment near the objects, and/or the assemblies themselves.

Although other measuring devices 22 may be used without departing from the scope of the present invention, in one embodiment the measuring device is a strain gauge. Moreover, the automated warning systems described and illustrated herein may include any suitable measuring device for measuring any parameter of the platform assembly and/or the object. Parameters for the platform assembly and/or the object may include, but are not limited to, any force acting on, any deformation of, and/or any parameter related to failure and/or fatigue of any component of the platform assembly and/or the object (e.g., stress, strain, torque, temperature, etc.). Additionally, although the automated warning system 20 is illustrated in FIG. 1 as including only one measuring device 22 for measuring one parameter, the automated warning systems described and illustrated herein may each include a plurality of measuring devices for measuring a plurality of parameters of the platform assembly and/or the object. The plurality of parameters may include a plurality of the same and/or different parameters. Additionally, the plurality of parameters may be measured by the plurality of measuring devices 22 at the same and/or a plurality of different locations. Alternatively, one measuring device 22 may be used to measure a plurality of the same parameters at the same and/or a plurality of different locations.

Warnings generated by the warning device 24 may include messages regarding how a parameter compares with a limit. For example, such warnings may include, but are not limited to, messages that a parameter is safely below a limit, is approaching a limit and/or has reached or exceeded a limit, messages that the platform assembly, the object, and/or a component of the assembly and/or the object is safe or not safe to access and/or use, messages that access to and/or use of the platform assembly the object, and/or a component of the assembly and/or the object is accepted or denied, messages that access to and/or use of the platform assembly, the object, and/or a component of the assembly and/or the object is being prevented or allowed, messages that the platform assembly, the object, and/or a component of the assembly and/or the object is being supported by a safety device, messages that the platform assembly, the object, and/or a component of the assembly and/or the object is being damaged, prevention of access to and/or use of the platform assembly, the object, and/or a component of the assembly and/or the object, support of the platform assembly, the object, and/or a component of the assembly and/or the object, scheduling and/or performance of maintenance on the platform assembly, the object, or a component of the assembly and/or the object, scheduling and/or performance of tests on the platform assembly, the object, or a component of the assembly and/or she object, storage of a parameter value, comparing a parameter value with another parameter value, and/or any action and/or message relating to failure and/or fatigue of the platform assembly, the object, and/or a component of the assembly and/or the object.

Although other warning devices 24 may be used without departing from the scope of the present invention, the warning device 24 may be selected from a group of warning devices consisting of an audible message, a visual message, a monitoring station, a subsystem for preventing access to the platform assembly, the object, and/or a component of the assembly and/or the object, and a safety device for supporting the platform assembly, the object, and/or a component of the assembly and/or the object. Additionally, although the automated warning system 20 is illustrated in FIG. 1 as including only one warning device 24, the automated warning systems described and illustrated herein may each include a plurality of warning devices (of the same and/or a different type) for providing a plurality of warnings relating to one or more parameters. For example, a plurality of warning devices 24 may be used to generate a plurality of different warnings each relating to the same and/or a different parameter. Alternatively, one warning device 24 may be used to generate a plurality of different warnings relating to one or more parameters. When, a monitoring station is used as a warning device 24, a processor (not shown) of the station and/or a human operator may determine from the station whether to generate a warning representing how a parameter compares to a limit upon receiving any instructions and/or any information from the processor 26.

The limit may be any value for which a warning is desired to represent how the parameter compares to the limit. The limit need not be the failure value defined above. For example, to provide a factor of safety the limit may be below the failure value, or the limit may be a value that if exceeded, either once or continuously, will change the failure value. Additionally, the automated warning systems described and illustrated herein are not limited to only one limit (for one or more of the same or different parameters). Rather, a plurality of limits may be used for one or more of the same and/or different parameters. For example, a plurality of limits may be used with the same parameter to produce a plurality of different warnings depending on how the parameter compares with one or more of the limits.

The information relating to the design and/or operation of the platform assembly and/or the object may be stored by the automated warning systems described and illustrated herein and/or may be received by the systems for each measurement of a parameter. The information relating to the design and/or operation of the platform assembly and/or the object generally includes the design and/or operational characteristics of the platform assembly and/or the object. More specifically, the information may include, but is not limited to, a size and/or a shape of the platform assembly, a size of a component of the assembly, a shape of a component of the assembly, a material of a component of the assembly, a size and/or shape of the object, a size of a component of the object, a shape of a component of the object, a material of a component of the object, a configuration of a component of the object, a configuration of a component of the assembly, a history of parameter values for at least one of the assembly and the object, a configuration of an attachment between the assembly and the object, and/or a configuration of a support (e.g., the support 56 shown in FIG. 2) of the assembly (e.g., how the support supports the remainder of the platform assembly). The information is not limited to any specific examples described herein but rather may be any information relevant to determination of a limit for a parameter. Additionally, the information relating to the design and/or operation of the platform assembly and/or the object that is considered by the processor 26 in determining a limit for a parameter of the assembly and/or the object may vary depending on the particular parameter measured, the location of the parameter, a particular component of the assembly and/or the object being monitored, by the systems (e.g., the component most likely to fail under heavy loading during normal use of the assembly and/or the object), and/or the particular configuration of the platform assembly and/or the object.

Figure 2:
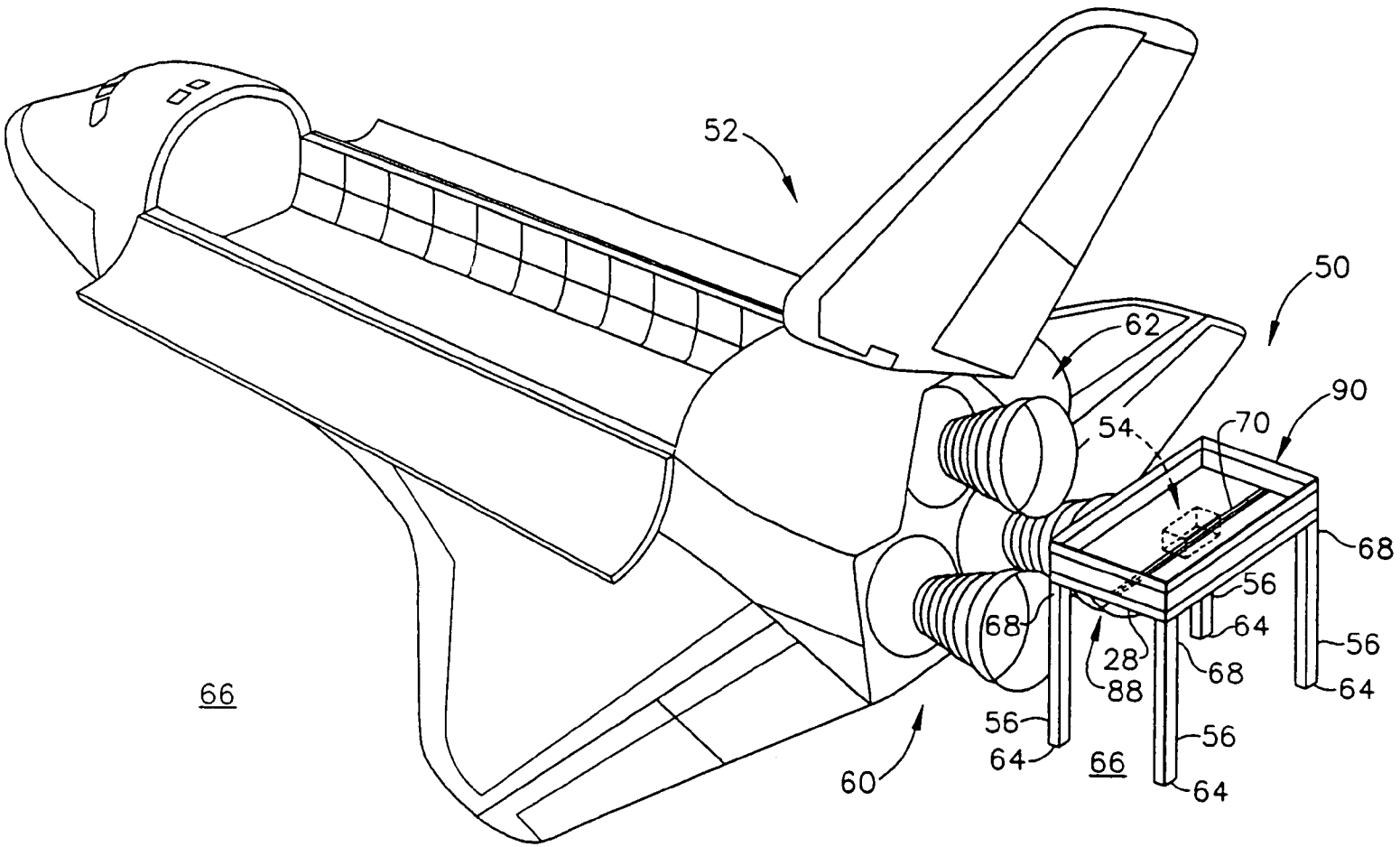
FIG. 2 is a perspective of a space vehicle and a platform assembly of the present invention.

Although the automated warning system of the present invention is suitable for use with any object, as illustrated in FIG. 2 a platform assembly (generally designated by 50) providing access to a space vehicle (generally designated by 52) includes an automated warning system (generally designated by 54) of the present invention. The platform assembly 50 also includes a plurality of supports 56 and a platform 58 extending from and supported by the plurality of supports. The platform assembly 50 is constructed near an aft end (generally designated by 60) of the space vehicle 52 to provide access to the main engines (generally designated by 62) of the vehicle. As illustrated in FIG. 2, the plurality of supports 56 each include an end 64 that rests on, or alternatively is fixedly secured to, a surface 66 (e.g., a floor of a building (not shown)) on which the vehicle rests. The platform 58 is attached to another end 68 of each of the supports 56 opposite the end 64. The supports 56 support the platform 58 above the surface at a location allowing people and/or equipment to access the main engines 62 of the vehicle 52 from the platform. The automated warning system 54 includes a measuring device 70 mounted on the platform 58 for measuring a parameter of the platform.

Figure 3:
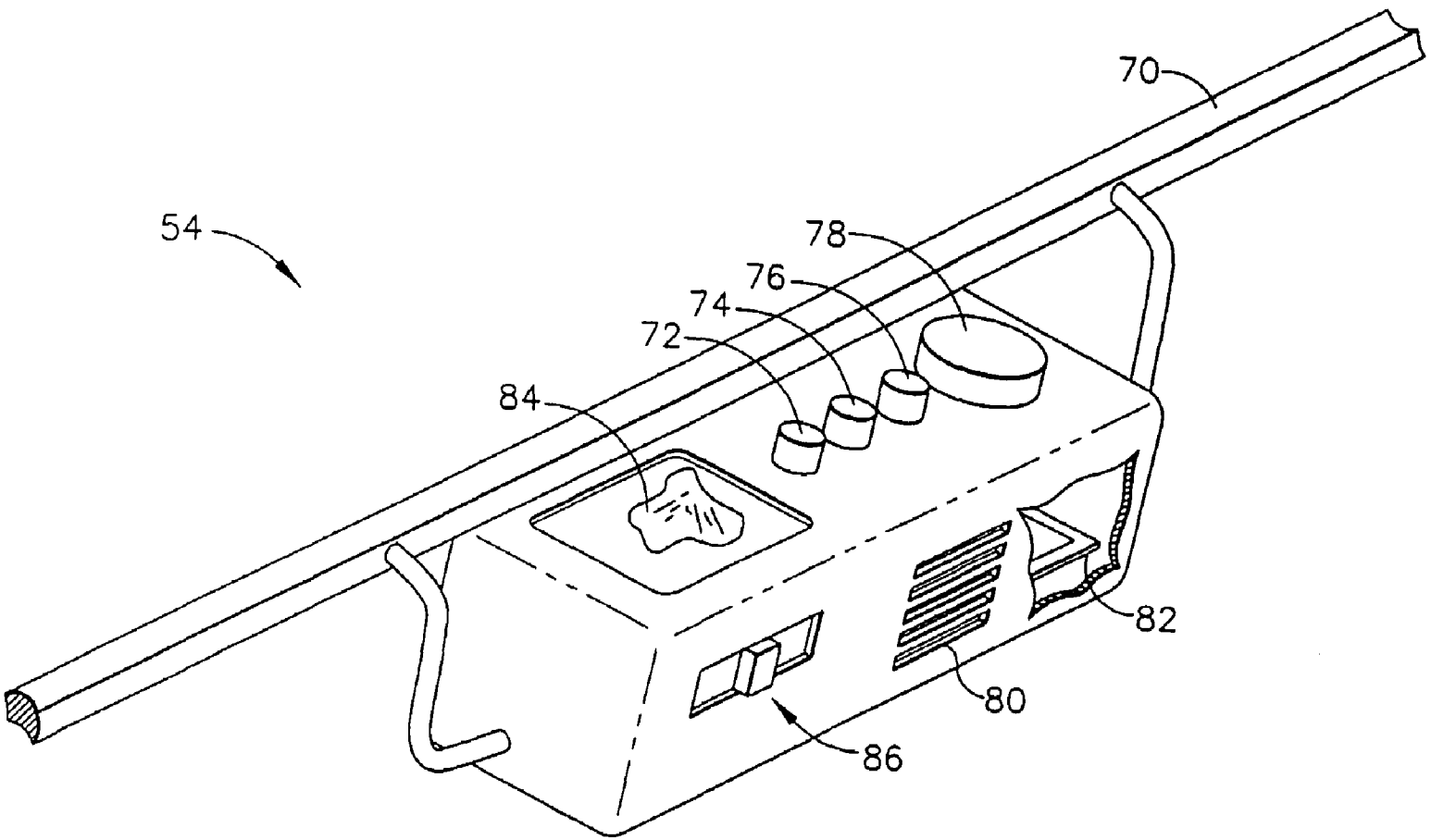
FIG. 3 is a partially cut away perspective of the automated warning system shown in FIG. 2.

As illustrated in FIG. 3, the automated warning system 54 also includes a plurality of warning devices 72, 74, 76, 78, 80 for generating a plurality of warnings as described above, a processor 82 operatively connected to the measuring device 70 and the warning devices, and a power source 84. The processor 82 may include an interface (not shown) for general communication and for receiving information relating to the design and/or operation of the platform assembly 50 and/or the vehicle 52, as described above with regard to the processor 26 (FIG. 1). In the exemplary embodiment illustrated in FIGS. 2 and 3, the measuring device 70 is a strain gauge extending generally along the platform 58 for measuring strain of the platform. In one embodiment the strain gauge is calibrated using offset nulling and/or shunting methods, although other calibration methods may be used without departing from the scope of the present invention. Furthermore, as illustrated in FIG. 3 the warning device 72 generates a visual message that the strain of the platform 58 (FIG. 2) is safely below a limit for the strain, the device 74 generates a visual message that the strain is approaching the limit, the device 76 generates a visual message that the strain has exceeded the limit, the device 78 generates a visual message that the platform is not safe to access and/or use, and the device 80 generates an audio message that the platform is not safe to access and/or use. Alternatively, as discussed above with regard to the system 20, the system 54 may include only one warning device that generates some or all of the warnings generated by the devices 72, 74, 76, 78, 80.

In one embodiment, the processor 82 includes a switch (generally designated by 86) for selectively choosing between different information relating to the design and/or operation of the platform assembly 50 (FIG. 2) and/or the vehicle 52 (FIG. 2) to be considered by the processor in determining a limit for the strain of the platform 58. The switch 86 allows an operator to selectively choose between different information to be considered by the processor 82 without reprogramming the processor, which may be inconvenient in some circumstances. Although any different information relating to the design and/or operation of the platform assembly 50 and/or the vehicle 52 may be selected between using the switch 86, in one embodiment the switch selects whether the platform is supported at first end (generally designated by 88 in FIG. 2), a second end (generally designated by 90 in FIG. 2) opposite the first end 88, or both ends 88, 90. As described above with regard to the system 20, the information relating to the design and/or operation of the platform assembly 50 and/or the vehicle 52 that is considered by the processor 82 in determining a limit for the strain of the platform 58 will vary depending on where the strain is measured and the particular configuration of the platform assembly 50 and/or the vehicle 52.

In operation, the processor 82 receives information relating to the design and/or operation of the platform assembly 50 and/or the vehicle 52, determines a limit for the strain of the platform 58 based on the information, and compares the strain measured by the measuring device 70 to the limit. When the strain is safely below the limit, the processor 82 activates the warning device 72 to generate a visual message that the strain of the platform 58 is safely below a limit for the strain. When the strain is approaching the limit, the processor 82 activates the device 74 to generate a visual message that the strain of the platform 58 is approaching the limit. When the strain has exceeded the limit, the processor 82 activates the device 76 to generate a visual message that the strain of the platform 58 has exceeded the limit. The processor 82 may also activate the device 78 to generate a visual message that the platform 58 is not safe to access and/or use when the strain has exceeded the limit. The processor 82 may also activate the device 80 to generate an audio message that the platform 58 is not safe to access and/or use when the strain has exceeded the limit.

Figure 4:
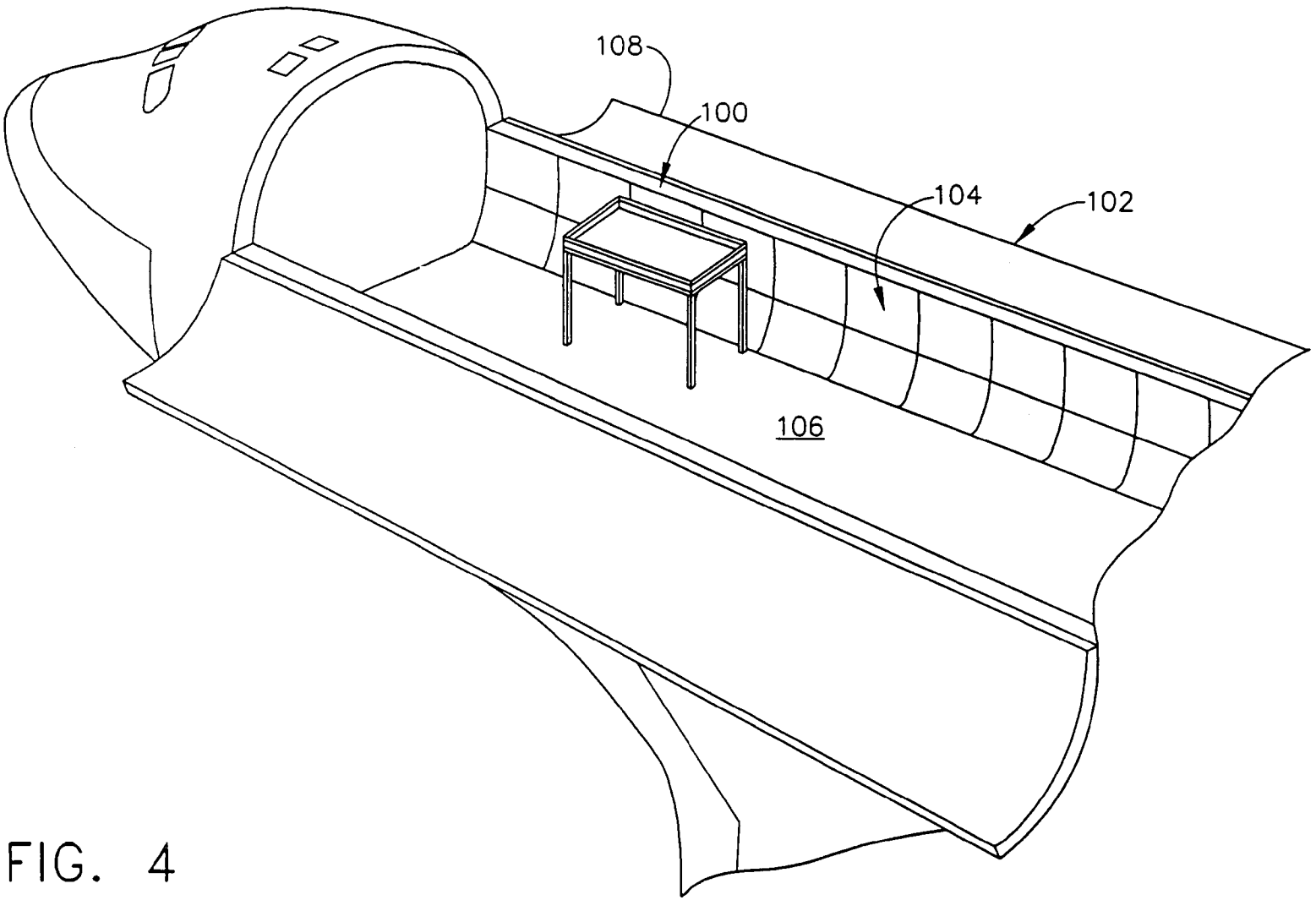
FIG. 4 is a perspective of an alternative configuration of the space vehicle and the platform assembly.
Figure 5:
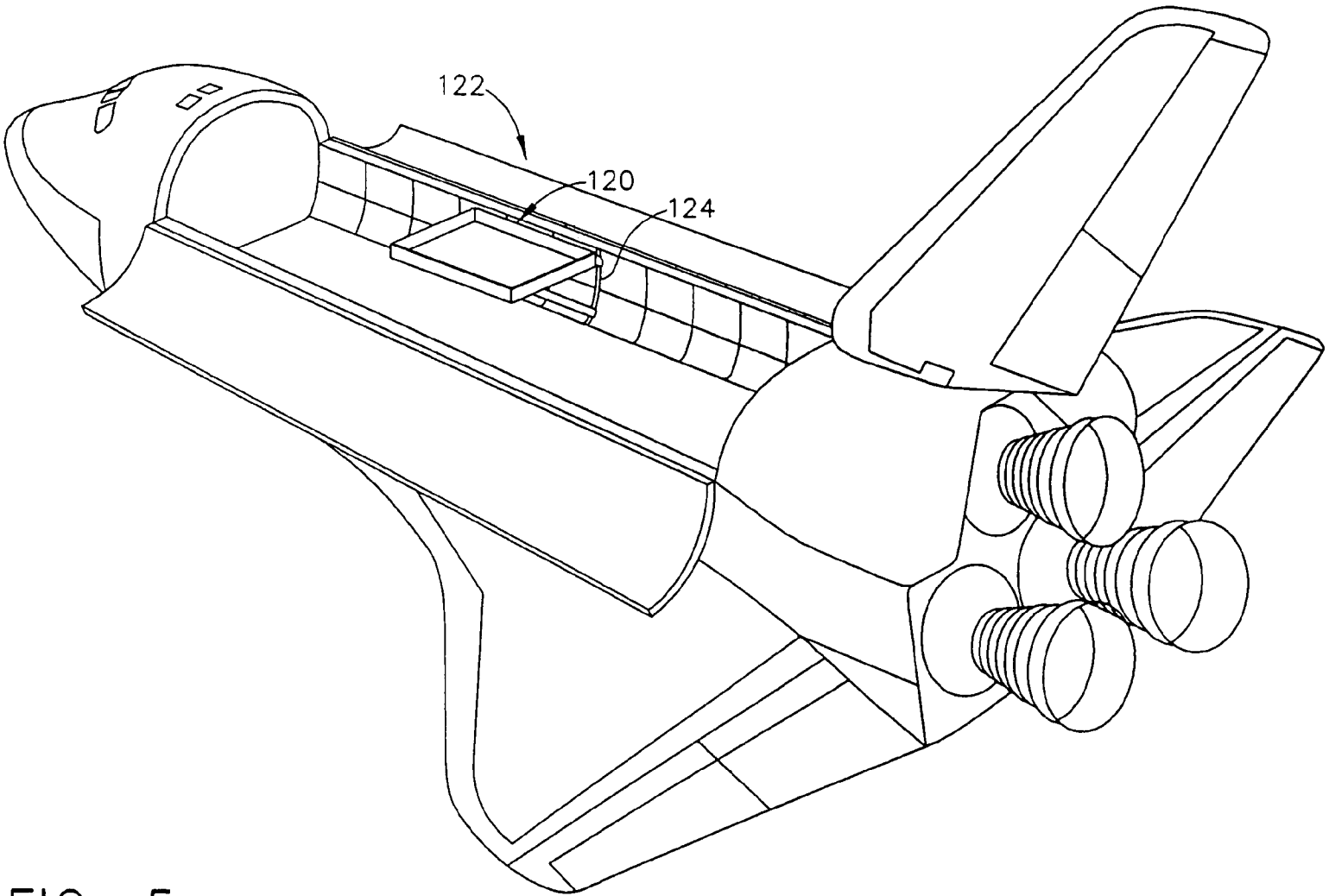
FIG. 5 is a perspective of another alternative configuration of the space vehicle and the platform assembly.

Although the platform assembly 50 is illustrated in FIG. 2 and described herein as being constructed near the vehicle 52 and being supported by the surface 66, the automated warning systems of the present invention may be used in combination with, or as a component of, platform assemblies of any size, shape, any number of components (e.g., the supports 56 or the platform 58), or configurations, and platform assemblies constructed from any material(s). Moreover, the automated warning systems of the present invention may be used in combination with, or as a component of, platform assemblies constructed near and/or within (at least partially) any object and/or component thereof in any fashion, and/or assemblies attached to any object and/or component thereof in any fashion. For example, the supports 56 of the assembly 50 may alternatively extend from other surfaces such as a wall (not shown) and/or a ceiling (not shown) of the building containing the vehicle 52. FIG. 4 illustrates an example of a platform assembly (generally designated by 100) constructed inside a space vehicle (generally designated by 102). More specifically, the assembly 100 is supported within a payload bay (generally designated by 104) by a floor 106 of the bay to provide access to a payload bay door 108. FIG. 5 illustrates an example of a platform assembly (generally designated by 120) attached to a space vehicle (generally designated by 122). More specifically, the assembly 120 is attached to and supported by a support 124 to provide access to the payload bay. When an automated warning system of the present invention is used in combination with, or as a component of, a platform assembly that is attached to an object (as illustrated in FIG. 5), the system may generate warnings representing how parameters of the object that result from forces transmitted from the platform assembly to the object compare to limits for the parameters. Accordingly, the configuration may be useful for monitoring the effect of access to and/or use of a platform assembly on an object and/or components thereof to prevent the assembly from damaging the object and/or components thereof during use.

The above-described automated warning systems are cost effective and reliable for representing how parameters of platform assemblies and/or objects compare to certain limits. More specifically, the automated warning systems of the present invention may prevent platform assemblies from being overloaded, improperly constructed, and/or improperly attached to objects by generating warnings representing how parameters of the assemblies compare to certain limits. Accordingly, the systems may prevent platform assemblies from failing and/or fatiguing, and thereby possibly injuring people working on or near the platforms, and/or damaging the objects, equipment near the objects, and/or the assemblies themselves. Additionally, the automated warning systems described and illustrated herein may be useful for monitoring the effect of platform assemblies on objects and/or components thereof when the assemblies are attached to the objects. More specifically, the systems generate warnings representing how parameters of the objects that result from forces transmitted from the platform assemblies to the objects compare to certain limits. The systems therefore may prevent the assemblies from damaging the objects and/or components thereof when the assemblies are attached to the objects. Moreover, the systems of the present invention may further reduce injury and/or damage by preventing access to the platform assemblies and/or supporting components of the assemblies when the parameters reach or exceed certain limits.

Although the invention is specifically described and illustrated in association with a platform assembly for a space vehicle, it should be understood that the present invention is generally applicable to any platform assembly for any object. Accordingly, practice of the present invention is not limited to platform assemblies for space vehicles or vehicles generally, nor is practice of the present invention limited to any specific platform assembly and/or object described and/or illustrated herein.

Exemplary embodiments of automated warning systems and methods are described above in detail. The methods and systems are not limited to the specific embodiments described herein, but rather, components of each system may be utilized independently and separately from other components described herein, and steps of each method may be utilized independently and separately from other steps described herein. Each automated warning system component can also be used in combination with other automated warning system components. Additionally, each automated warning method step can also be used in combination with other automated warning method steps.

As used herein, the term "object" is intended to mean any thing (e.g., a vehicle, a building, a topographical feature, or a living organism) wherein a platform assembly may be attached to, or constructed within or near, the thing to provide access to parts of the thing that may be difficult to get to and/or work on.

When introducing elements of the present invention or the preferred embodiment(s) thereof, the articles "a", "an", "the" and "said" are intended to mean that there are one or more of the elements. The term "plurality" is intended to mean there are two or more of the corresponding elements. The term "multiplicity" is intended to mean that there are three or more of the corresponding elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. An automated warning system for use in combination with a platform assembly including a platform for holding personnel and/or items used to perform work on an object, said system comprising:

a measuring device mountable on the platform assembly for measuring a parameter representing loading of said personnel and/or said items on the assembly;

a warning device for generating a warning; and a processor operatively connected to the measuring device and the warning device, said processor being configured to:

receive information related to at least one of the design and operation of at least one of the platform assembly and the object;

determine a limit for the parameter based on the information;

compare the parameter to the limit; and activate the warning device to generate a warning when the parameter unfavorably compares to the limit.

2. A system in accordance with claim 1 wherein the warning device is selected from a group of warning devices consisting of an audible warning device, a visual warning device, a monitoring station, a sub-system for preventing access to the platform assembly, and a safety device for supporting a component of the assembly.

3. A system in accordance with claim 1 wherein the information relating to at least one of the design and operation of the platform assembly comprises at least one of a size of the platform assembly, a shape of the assembly, a size of a component of the assembly, a shape of a component of the assembly, a material of a component of the assembly, a configuration of a component of the assembly, a history of parameter values for the assembly, a configuration of an attachment between the assembly and the object, and a configuration of a support of the assembly.

4. A system in accordance with claim 1 wherein the processor is further configured to select the parameter.

5. A system in accordance with claim 4 wherein the processor is configured to select the parameter based on the information relating to at least one of the design and operation of at least one of the platform assembly and the object.

6. A platform assembly for use in combination with an object, said assembly comprising:

a support;

a platform extending from the support for holding personnel and/or items used to perform work on said object;

a measuring device mounted on at least one of the platform, the support, and the object for measuring a parameter representing loading of said personnel and/or said items on at least one of the platform, the support, and the object;

a warning device for generating a warning; and a processor operatively connected to the measuring device and the warning device, said processor being configured to:

receive information relating to at least one of the design and the operation of at least one of the platform assembly and the object;

determine a limit for the parameter based on the information;

compare the parameter to the limit; and activate the warning device to generate a warning when the parameter compares unfavorably to the limit.

7. An assembly in accordance with claim 6 wherein the warning device is selected from a group of warning devices consisting of an audible warning device, a visual warning device, a monitoring station, a system for preventing access to at least one of the platform assembly and the object, and a safety device for supporting a component of at least one of the assembly and the object.

8. An assembly in accordance with claim 6 wherein design information comprises at least one of a size of the platform assembly, a shape of the assembly, a size of the support, a shape of the support, a material of the support, a size of the platform, a shape of the platform, a material of the platform, a size of the object, a shape of the object, a size of a component of the object, a shape of a component of the object, a material of a component of the object, a configuration of a component of the object, a configuration of the support, a configuration of the platform, a history of parameter values for at least one of the assembly and the object, and a configuration of an attachment between the assembly and the object.

9. An assembly in accordance with claim 6 wherein at least one of the support and the platform are attached to the object.

10. An assembly in accordance with claim 6 wherein at least one of the support and the platform are positioned at least partially within the object.

11. An assembly in accordance with claim 6 wherein the processor comprises a switch for selectively choosing between different information relating to at least one of the design and operation of at least one of the platform assembly and the object to be considered by the processor in determining a limit for the parameter of at least one of the platform, the support, and the object.

12. An assembly in accordance with claim 6 wherein the processor is further configured to select the parameter.

13. An assembly in accordance with claim 6 wherein said support is secured to a generally immovable floor.

14. An assembly in accordance with claim 6 wherein at least one of the support and the platform are positioned adjacent the object.

15. An assembly in accordance with claim 6 wherein said platform includes a substantially horizontal surface that holds said personnel and/or said items during use of the platform.

16. An assembly in accordance with claim 6 wherein said support and said platform are substantially free of connections to said object.

17. An automated warning system for use in combination with a platform assembly attached to an object and including a platform for holding personnel and/or items used to perform work on the object, said system comprising:

a measuring device mountable on the object for measuring a parameter representing loading on the object resulting from force transmitted from said personnel and/or said items on the platform assembly to the object;

a warning device for generating a warning; and a processor operatively connected to the measuring device and the warning device, said processor being configured to:

compare the parameter to a limit for the parameter; and activate the warning device to generate a warning when the parameter compares unfavorably with the limit.

18. A system in accordance with claim 17 wherein the processor is configured to:

receive information relating to at least one of the design and operation of at least one of the platform assembly and the object; and determine the limit based on the information.

19. A system in accordance with claim 17 wherein the warning device is selected from a group of warning devices consisting of an audible warning device, a visual warning device, a monitoring station, a sub-system for preventing access to the object, and a safety device for supporting a component of the object.

20. A system in accordance with claim 18 wherein the information relating to at least one of the design and operation of at least one of the platform assembly and the object comprises at least one of a size of the platform assembly, a shape of the assembly, a size of a component of the assembly, a shape of a component of the assembly, a material of a component of the assembly, a configuration of a component of the assembly, a size of the object, a shape of the object, a size of a component of the object, a shape of a component of the object, a material of a component of the object, a configuration of a component of the object, a history of parameter values for the object, a configuration of an attachment between the assembly and the object, and a configuration of a support of the assembly.

* * * * *